US006516489B2

(12) United States Patent
Rose

(10) Patent No.: US 6,516,489 B2
(45) Date of Patent: Feb. 11, 2003

(54) X-TENDO MITT

(76) Inventor: Steven Lee Rose, 24703 60$^{th}$ Ave. E., Graham, WA (US) 98338

( * ) Notice: Subject to any disclaimer, the term of this patent is extended or adjusted under 35 U.S.C. 154(b) by 0 days.

(21) Appl. No.: 10/162,373

(22) Filed: Jun. 5, 2002

(65) Prior Publication Data

US 2002/0162182 A1 Nov. 7, 2002

Related U.S. Application Data

(63) Continuation-in-part of application No. 09/716,673, filed on May 7, 2001, now abandoned.

(51) Int. Cl.$^{7}$ ..... A47L 13/12

(52) U.S. Cl. ..... 15/210.1; 15/114

(58) Field of Search ..... 15/106, 107, 114, 15/209.1, 210.1, 219, 247

(56) References Cited

U.S. PATENT DOCUMENTS

| | | | | |
|---|---|---|---|---|
| 3,332,103 | A | * | 7/1967 | Case |
| 4,375,115 | A | * | 3/1983 | Zimmerman |
| 5,161,279 | A | * | 11/1992 | Sager et al. |
| 5,280,664 | A | * | 1/1994 | Lln |
| 5,323,506 | A | * | 6/1994 | Babitch |
| 5,341,538 | A | * | 8/1994 | Banome |
| 5,591,507 | A | * | 1/1997 | Jones |
| 5,806,128 | A | * | 9/1998 | Love |

* cited by examiner

*Primary Examiner*—Terrence R. Till

(57) ABSTRACT

An adjustable cleaning tool adapted to clean facing surfaces of closely spaced parallel surfaces is made of thin rigidly flexible inner mount and removable fabric outer sleeve cover having scrubber material associated therewith. When the device is inserted between closely spaced parallel surfaces sliding movement of the device between the surfaces makes this cleaning tool easy to contact and clean surfaces neglected due to inaccessibility.

6 Claims, 3 Drawing Sheets

Plan

Section

Section

X-TENDO MITT

This is a Continuation-in-part of application Ser. No. 09/716,673, filed May 7, 2001.

BACKGROUND OF THE INVENTION

1. Field of the Invention

This invention relates to an automobile-washing device and more particularly is a device for simultaneously cleaning the back window cab area of a pick-up truck and associated canopy shell/camper.

2. Description of the Related Art

Related devices are designed primarily for the cleaning of exterior surfaces of vehicles and are too wide to be inserted into the gap between the parallel surfaces of the pick-up truck cab and a canopy shell/camper mounted thereupon Often this space is less than two inches. The cleaning of this area cannot be reached because the hand and arm will not fit within the narrow gap. Moreover, most pick-up trucks have a high ground clearance, which compounds the need for additional reach. It is therefore an object of this invention to provide a cleaning device, which may be inserted upon said facing surfaces to dislodge dirt.

SUMMARY OF THE INVENTION

The beneficial advantages are accomplished by the present invention by being adapted to clean the facing surfaces of the rear portion of a pick-up truck cab and closely adjacent canopy shell/camper by:

a) having a handle and applicator mount that is rigid enough to keep its integrity, flexible enough to bear pressure for scrubbing both surfaces to free stubborn dirt and grime, thin enough to fit within a narrow gap and long enough to reach where a hand and arm cannot. Said mount may be a monolithic unit of polyethylene plastic or hinged between the body of the mount and the handle to allow an angle.

b) A lambs wool or synthetic wool sleeve-cover that is not abrasive to paint but is a proven effective cleaning material.

c) Scrubber material bonded to elastic is adapted to be removably emplaced upon said sleeve to treat surfaces long neglected for inaccessibility.

c) Hook and loop fastener at the handle end of said sleeve make it removable for routine laundering.

d) Can be used to clean, wash and dust, and may be used wet or dry.

DETAILED DESCRIPTION

Figure 1:
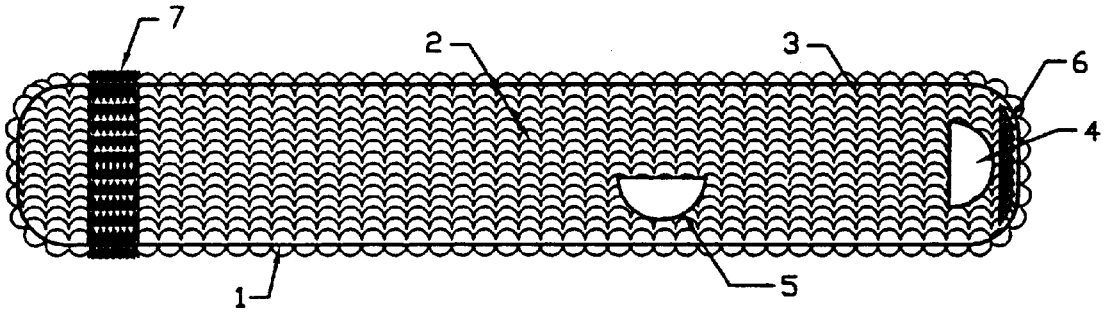
FIG. 1 is a perspective drawing of the three foot long X-Tendo Mitt Reference 1 identifies the plastic mount. Reference 2 identifies the wool cleaning surface. Reference 3 identifies the sleeve cover. Reference 4 identifies the handle. Reference 5 identifies the side hand-hold. Reference 6 identifies the hook and loop fastener. Reference 7 identifies the scrubber band.
Figure 2:
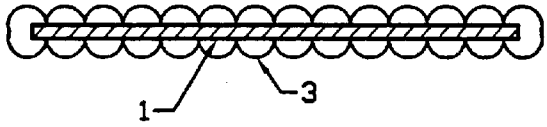
FIG. 2 is a sectional view of FIG. 1 showing sleeve cover 3 and plastic mount 1.
Figure 3:
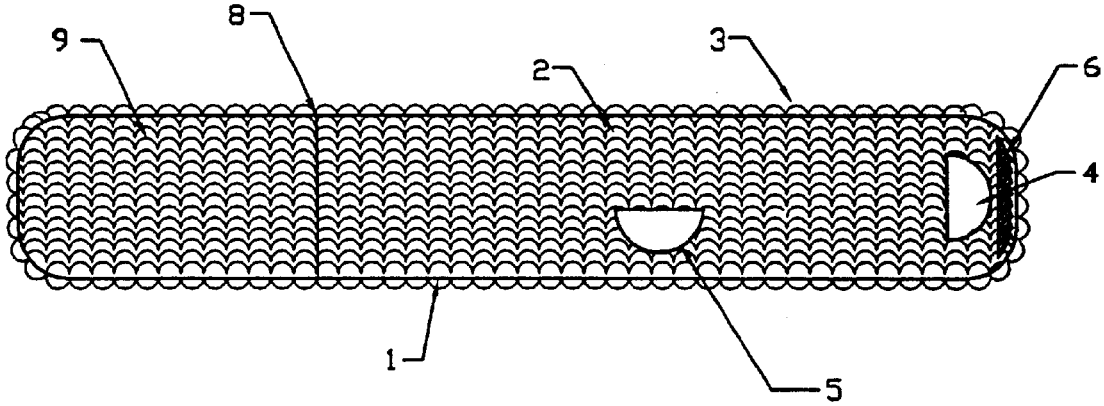
FIG. 3 is perspective drawing including the hinge area. Reference 8 identifies the hinge. Reference 9 identifies cleaning surface beyond hinge.
Figure 4:
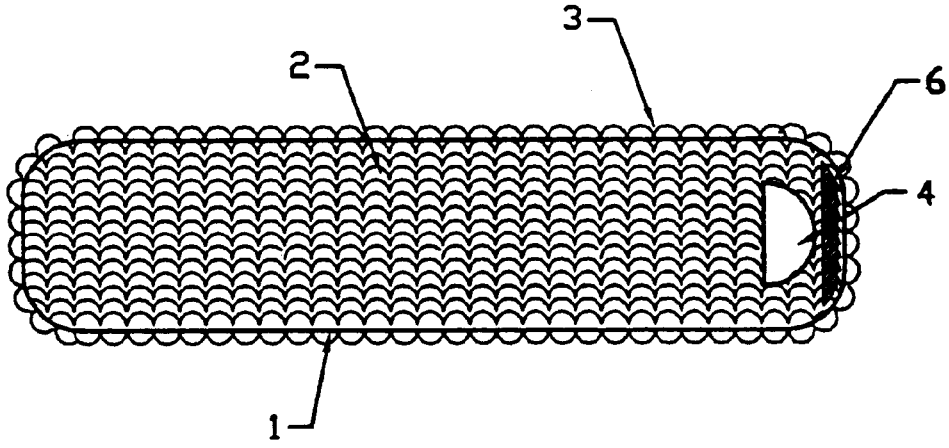
FIG. 4 is a perspective drawing of the two foot long X-Tendo Mitt.
Figure 5:
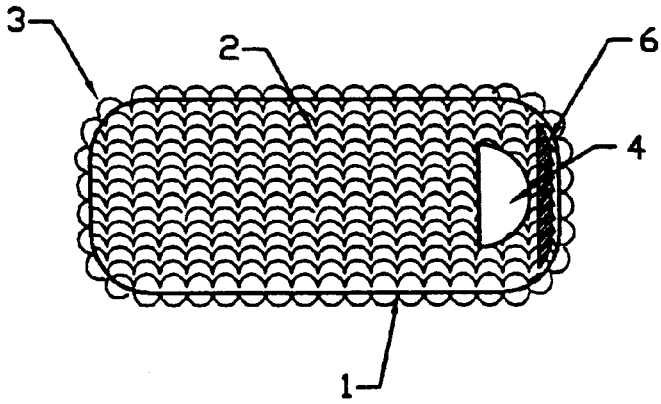
FIG. 5 is a perspective drawing of the one foot long X-Tendo Mitt.
Figure 6A:
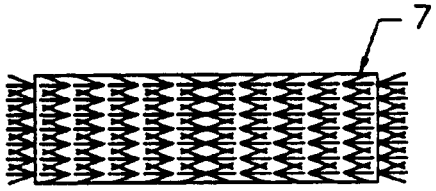
FIG. 6A is a drawing of the scrubber material bonded to elastic 7.
Figure 6B:
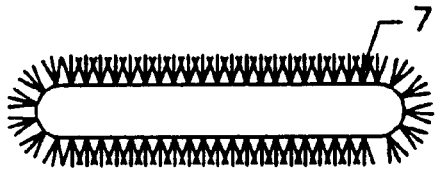
FIG. 6B is a sectional drawing of the scrubber material bonded to elastic 7.
Figure 7:
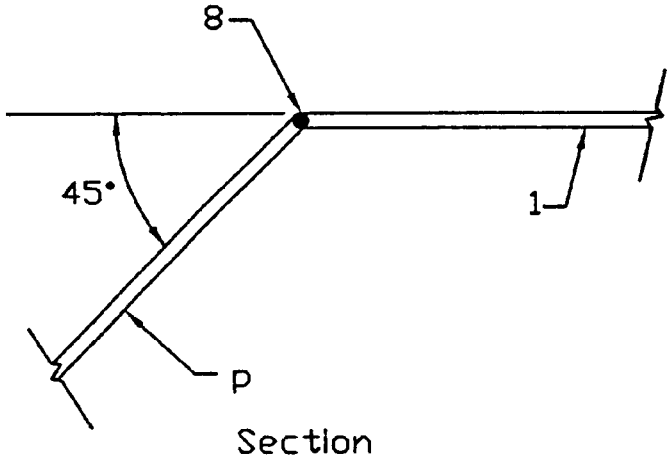
FIG. 7 is a sectional drawing of the hinge 8 and the cleaning surface beyond the hinge 9.

The X-Tendo Mitt is shown in seven drawings in the accompanying drawings (FIGS. 1, 2, 3, 4, 5, 6A, 6B and 7). The removable applicator sleeve cover 3 is made of lambs wool or synthetic lambs wool that is washable, non-abrasive , absorbent and a proven effective cleaning material either wet or dry for cleaning or dusting. The wool cleaning surface 2 of the sleeve cover 3 entirely encases the plastic mount 1 (FIG. 2) and the loft of said wool cleaning surface allows the invention to make complete contact with two closely related surfaces simultaneously.

The mount 1 is fabricated of plastic material, such as polyethylene as it is resilient in thin sections (FIGS. 2 & 7), rigid enough to support the sleeve cover 3, and flexible enough to take the of task to be performed without bending overmuch or and is light weight enough to make an efficient and comfortable tool. Said mount should be long enough to reach the surface to be cleaned making an extension of hand and arm Each of the described lengths of the said device (FIGS. 1, 4 and 5) have special advantages depending on the depth of the area to be cleaned. Said mount can be straight (FIG. 3) or bent at hinge 8 (FIG. 7) up to a 45 degrees within said sleeve cover which makes an angular cleaning surface 9.

Quick release, hook and loop fastener 6 located on outer extremity of said sleeve cover near handle 4 makes opening for inserting mount 1 into sleeve 3 fast and efficient. After sleeve 3 is emplaced on mount 1 which is rounded on both ends to add ease, said hook and loop fastener is closed and sleeve 3 is fitted securely.

The handle 4 and hand-hold 5 may be integral with the said mount as a result of manufacture by a molding process or cut out process. The operator guides the device with the handle 4 in a back and forth sliding motion, inserting it between two closely adjacent surfaces so that all portions of surfaces may be cleaned. The optional hand-hold 5 helps guide and is desirable if using wet in the longer length due to added weight.

Scrubber band 7 has bristles or scrubber material bonded to an elastomeric or equivalent material (FIGS. 6A and 6B) which permits the band to be stretched and emplaced upon the device and become secured by contractive force (FIG. 1). One or more bands may be placed along length of device (FIG. 1) when used in either straight or bent positions, with scrubber material contacting both adjacent surfaces.

Having thus described my invention, what is claimed is:

1. A cleaning device adapted to clean the rear window/cab surface of a pick-up truck and front surface of a closely adjacent canopy/camper shell, said device comprised of:

a) rigid yet flexible plastic applicator mount that is of monolithic construction or b) hinged and covered with a c) lambs wool or synthetic wool sleeve-cover extending over the length of the mount secured at one end by d) hook and loop closure, and e) scrubber material bonded to an elastic band, and f) at least one handle to manipulate the device against said surfaces.

2. The device of claim 1 wherein the sleeve cover is removably associated with said mount member.

3. The device of claim 2 wherein said scrubber material is in the form of a band which must be stretched over and emplaced upon sleeve cover, and is secured in place by contractive force.

4. The device of claim 1 wherein said scrubber material is removably associated with said sleeve cover.

5. The device of claim 1 wherein said mount is bent at hinge with respect to its length up to a forty five degree angle within said sleeve cover.

6. The device of claim 1 wherein a second hand-hold is formed along the side of the mount.

* * * * *